US006679719B2

(12) United States Patent
Endo et al.

(10) Patent No.: US 6,679,719 B2
(45) Date of Patent: Jan. 20, 2004

(54) HALF-FITTING PREVENTION CONNECTOR

(75) Inventors: Tomomi Endo, Shizuoka (JP); Naoto Taguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 3 days.

(21) Appl. No.: 10/232,536

(22) Filed: Sep. 3, 2002

(65) Prior Publication Data

US 2003/0045161 A1 Mar. 6, 2003

(30) Foreign Application Priority Data

Sep. 5, 2001 (JP) ..... P2001-269083
Aug. 1, 2002 (JP) ..... P2002-225227

(51) Int. Cl.[7] ..... H01R 13/58
(52) U.S. Cl. ..... 439/352; 439/489
(58) Field of Search ..... 439/352, 489, 439/357–358, 752

(56) References Cited

U.S. PATENT DOCUMENTS 5,192,225 A * 3/1993 Suzuki ..... 439/489
5,435,742 A * 7/1995 Cecil, Jr. ..... 439/347
5,605,471 A * 2/1997 Plyler ..... 439/489
5,643,003 A * 7/1997 Myer et al. ..... 439/352
5,775,930 A * 7/1998 Model et al. ..... 439/352
5,807,130 A * 9/1998 Miller et al. ..... 439/352
5,827,086 A 10/1998 Fukuda
5,928,038 A * 7/1999 Berg et al. ..... 439/752
5,938,470 A * 8/1999 Kashiyama ..... 439/489
5,947,763 A * 9/1999 Alaksin ..... 439/489
5,980,332 A * 11/1999 Tsuji et al. ..... 439/752
5,997,344 A * 12/1999 Shinozaki ..... 439/489
6,012,945 A * 1/2000 Tabor et al. ..... 439/489
6,068,507 A * 5/2000 Popa ..... 439/489
6,077,101 A * 6/2000 Garretson et al. ..... 439/352
6,109,955 A * 8/2000 Hanazaki et al. ..... 439/489
6,116,953 A * 9/2000 Myer ..... 439/595
6,171,130 B1 1/2001 Yoshida et al.
6,354,860 B1 * 3/2002 Miller et al. ..... 439/352
6,406,319 B2 * 6/2002 Pederson et al. ..... 439/352
6,419,515 B1 * 7/2002 Okayasu ..... 439/358
6,514,099 B2 * 2/2003 Endo ..... 439/489
6,533,601 B2 * 3/2003 Raudenbush et al. ..... 439/352

FOREIGN PATENT DOCUMENTS

| | | |
|---|---|---|
| EP | 1 049 214 A1 | 11/2000 |
| EP | 1 113 537 A2 | 7/2001 |
| JP | 3-285280 | 12/1991 |
| JP | 9-147986 | 6/1997 |
| JP | 11-204184 | 7/1999 |

* cited by examiner

*Primary Examiner*—Tho D. Ta
*Assistant Examiner*—Larisa Tsukerman
(74) *Attorney, Agent, or Firm*—Sughrue Mion, PLLC

(57) ABSTRACT

In a half-fitting prevention connector (11) of the invention, a female connector (20) includes a housing body (22), and a flexible lock arm (21) formed on an upper surface of the housing body (22). A projecting portion (21*c*) is formed at a front end of the flexible lock arm (21), and a lock arm guide groove (21*c*) is formed in a lower surface of the projecting portion (21*b*). A flexible lock arm-guide portion (30*c*) for fitting in the lock arm guide groove (21*c*) is formed on one side portion of an upper surface of a housing body (30*b*) of a male connector housing (30). A flexible lock arm-holding portion (41*c*) is formed on an upper portion of one inner side surface of a detection member body (41), and projects horizontally therefrom.

5 Claims, 15 Drawing Sheets

HALF-FITTING PREVENTION CONNECTOR

The present application is based on Japanese Patent Application Nos. 2001-269083 and 2002-225227, the entire contents of which are incorporated herein by reference.

BACKGROUND OF THE INVENTION

1. Field of the Invention

This invention relates to a half-fitting prevention connector, and more particularly to a half-fitting prevention connector in which when a pair of female and male connector housings are fitted together, a half-fitted condition of the female and male connector housings is detected by determining whether or not a fitting detection member, mounted on one of the connector housings, can be slid into a proper fitting detection position.

2. Related Art

In a conventional half-fitting prevention connector 1 shown in FIG. 15, when a pair of female and male connector housings F and M are fitted together, a half-fitted condition of the female and male connector housings F and M is detected by determining whether or not a lock confirmation slider S, mounted on the male connector housing (first connector housing) M, can be slid into a proper fitting detection position (see JP-A-3-285280).

A lock arm 2 extends rearwardly from a front end of an outer peripheral wall of the male connector housing M through its rising proximal end portion 2*a*, and a retaining projection 2*b* is formed on an intermediate portion of this lock arm, and a grasp portion 2*c* is formed at a rear end of the lock arm.

A lock detection arm 3, having a stopper 3*a* and a support guide 3*b*, is formed on the lock confirmation slider S.

The female connector housing F includes a lock chamber 4 having a retaining portion 4*a* for engagement with the retaining projection 2*b* of the lock arm 2.

FIG. 15A shows a condition in which the male connector housing M, having the lock confirmation slider S mounted thereon, and the female connector housing F are initially fitted together, and the lock detection arm 3 is held in an initial position, with the stopper 3*a* abutted against the retaining projection 2*b* of the lock arm 2 and also with the support guide 3*b* supporting the retaining projection 2*b*.

FIG. 15B shows a condition in which the male connector housing M is further inserted into the female connector housing F, and the lock arm 2 is elastically deformed downwardly, and the retaining projection 2*b* is held in sliding contact with a tapering guide portion 4*b* of the retaining portion 4*a* of the lock chamber 4.

FIG. 15C shows a condition in which the female and male connector housings F and M are completely fitted together, and the retaining projection 2*b* of the lock arm 2 is lockingly engaged with the retaining portion 4*a*, and the lock confirmation slider S has moved into a lock confirmation position. Therefore, it is confirmed that the female and male connector housings F and M are not in a half-fitted condition, but are completely fitted together.

In the above conventional half-fitting prevention connector 1, however, the fitted condition of the female and male connector housings F and M is judged by the position of the lock confirmation slider S, that is, by confirming whether the slider is located in the initial position or the lock confirmation position.

Therefore, it is necessary and essential that the lock confirmation slider S should be positively located in the initial position before the female and male connector housings F and M are fitted together, and when the lock confirmation slider S was disposed in other position than the initial position before the fitting operation, a half-fitted condition could not be detected in some cases.

Namely, before the fitting operation of the half-fitting prevention connector 1, the lock confirmation slider S is held in the initial position, with the stopper 3*a* of the lock detection arm 3*a* abutted against the retaining projection 2*b* of the lock arm 2. However, the lock arm 2 has a cantilever configuration, and extends rearwardly through its rising proximal end portion 2*a*, and therefore can be easily elastically deformed. Therefore, there was encountered a problem that when the lock arm 2 was elastically deformed upwardly (in the drawings), for example, by inadvertent contact, the retaining projection 2*b* was disengaged from the stopper 3*a*, so that the lock confirmation slider S was displaced forwardly from the initial position.

And besides, generally, each of the female and male connector housings F and M and the lock confirmation slider S is produced by injection molding of a resin, and unless the male connector housing M and the lock confirmation slider S are produced highly precisely, there has been encountered a problem that the amount of engagement between the retaining projection 2*b* and the stopper 3*a* is small when the male connector housing M and the lock confirmation slide S are combined together, so that it is difficult to hold the lock confirmation slider S in the initial position.

For fitting the female and male connector housings F and M not in a half-fitted condition but in the completely-fitted condition, it is necessary that the male connector housing M can be smoothly inserted and fitted into a predetermined position in the female connector housing F without being caught.

However, in the above half-fitting prevention connector 1, there is provided no guide member, and the female and male connector housings F and M guide each other merely through their bodies, and therefore in some cases, the male connector housing M was, in some cases, inclined during the fitting of this housing M into the female connector housing F. As a result, the axes of the female and male connector housings F and M were out of alignment with each other, so that it became difficult to fit the two connector housings together, and this was one cause of the half-fitted condition of the female and male connector housings F and M.

SUMMARY OF THE INVENTION

It is an object of this invention to provide a half-fitting prevention connector in which before female and male connector housings are fitted together, a fitting detection member is positively located in an initial position, and when fitting the female and male connector housings together, the two connector housings can be completely fitted together easily and positively, and besides the fitted condition can be confirmed.

(1) The above problems have been solved by a half-fitting prevention connector comprising:

a first connector housing having a flexible lock arm;

a second connector housing having an engagement portion for a first engagement with a lock portion of the flexible lock arm, and connectable to the first connector housing by the first engagement of the lock portion with the engagement portion when the second connector housing is fitted relative to the first connector housing;

a fitting detection member including a detection member body of a substantially tubular shape, fitted on an outer periphery of the first connector housing so as to slide in a fitting direction of the first and second connector housings, and a positioning retaining portion for a second engagement with the lock portion to hold the detection member body in an initial position; and a flexible lock arm-holding portion provided on the fitting detection member for preventing the flexible lock arm from being moved in a direction to cancel the second engagement of the lock portion with the positioning retaining portion.

In the half-fitting prevention connector of the above construction, before the first connector is fitted in the second connector housing, the fitting detection member, mounted on the first connector housing, is held in the initial position by the engagement of the positioning retaining portion with the lock portion. At this time, the flexible lock arm-holding portion prevents the flexible lock arm, having the lock portion, from being elastically deformed in the direction to cancel the engagement of the lock portion with the positioning retaining portion.

Therefore, before the first and second connector housings are fitted together, the flexible lock arm will not be elastically deformed, for example, by inadvertent contact with other part, and therefore the engagement of the lock portion with the positioning retaining portion will not be canceled. And besides, the fitting detection member can be positively held in the initial position, and the fitted condition of the first and second connector housings can be easily confirmed, and a half-fitted condition can be prevented.

When the fitting detection member is mounted on the first connector housing, the flexible lock arm is corrected into the proper position by the flexible lock arm-holding portion, thereby securing the proper amount of engagement between the lock portion and the positioning retaining portion.

Therefore, even if the flexible lock arm is deformed in a direction away from the positioning retaining portion, the flexible lock arm can be corrected so that the lock portion can be engaged with the positioning retaining portion in a proper amount. Therefore, when the first and second connector housings are fitted together, a half-fitted condition can be positively prevented.

(2) In the half-fitting prevention connector, the flexible lock arm-holding portion is formed on and projects from at least one inner side surface of the detection member body.

In the half-fitting prevention connector of this construction, the flexible lock arm-holding portion is formed on and projects such a distance from the one inner side surface of the detection member body as to reach a lower surface of one side portion of a front portion of the flexible lock arm.

Therefore, the front portion of the flexible lock arm is prevented from being inadvertently elastically deformed downwardly, thereby maintaining the mutually-engaged condition of the lock portion and the positioning retaining portion. The flexible lock arm-holding portions maybe formed respectively on the opposed inner side surfaces of the detection member body.

(3) Further, a half-fitting prevention connector is characterized in that a rib slidingly supported on the flexible lock arm-holding portion is formed on the flexible lock arm.

In the half-fitting prevention connector of the above construction, the rib on the flexible lock arm is slidingly supported with the flexible lock arm-holding portion.

Accordingly, the flexible lock arm is enhanced in its strength and the stability is improved. Thus unnecessary deflection in a forward and downward direction is reliably prevented so that the engagement between the lock portion and the positioning retaining portion is maintained.

(4) A half-fitting prevention connector of the invention is also characterized in that the connector comprises a first connector housing having a flexible lock arm, the flexible lock arm having a lock arm guide groove extending in a fitting direction of the first connector housing and a second connector housing;

the second connector housing having an engagement portion for a first engagement with a lock portion of the flexible lock arm, and connectable to the first connector housing by the first engagement of the lock portion with the engagement portion when the second connector housing is fitted relative to the first connector housing; and a fitting detection member including a detection member body of a substantially tubular shape, fitted on an outer periphery of the first connector housing so as to slide in the fitting direction of the first and second connector housings, the detection member body having a detection member guide groove extending in the fitting direction of the first and second connector housings, and a positioning retaining portion for a second engagement with the lock portion to hold the detection member body in an initial position;

wherein a flexible lock arm-guide portion and a fitting detection member-guide portion, which extend in the fitting direction of the first and second connector housings, are formed on the second connector housing; and when the first and second connector housings are fitted together, the flexible lock arm-guide portion is fitted in the lock arm guide groove while the fitting detection member-guide portion is fitted in the detection member guide groove.

In the half-fitting prevention connector of the above construction, when fitting the first and second connector housings together, the flexible lock arm-guide portion is fitted in the lock arm guide groove, and by doing so, the second connector housing can be properly positioned relative to the flexible lock arm, that is, the axis of the second connector housing can be aligned with the axis of the first connector housing, so that the fitting of the first and second connector housings can be effected smoothly.

And besides, at the same time, the fitting detection member-guide portion is fitted in the detection member guide groove, and therefore the axes of the second connector housing and the fitting detection member can be aligned with each other, so that the two can be fitted together smoothly. This eliminates one cause of the half-fitted condition, thereby positively preventing the half-fitted condition of the female and male connector housings.

(5) In the half-fitting prevention connector, the fitting detection member-guide portions are formed at least one pair on opposite side surfaces of an outer periphery of a housing body respectively, and the detection member guide grooves are formed respectively on an inner surface of the detection member body corresponding respectively to the fitting detection member-guide portions.

In the half-fitting prevention connector of this construction, at least one pair of fitting detection member-guide portions are respectively on the opposite side surfaces of the housing body, and therefore the axes of the second connector housing and the fitting detection member can be positively aligned with each other, so that the fitting operation can be effected more smoothly.

BRIEF DESCRIPTION OF THE DRAWINGS

FIG. 15A is the longitudinal cross-sectional view showing a condition before female and male connector housings are fitted together, and FIG. 15B is the longitudinal cross-sectional view showing a condition in which the female and male connector housings are in the process of being fitted together, and FIG. 15C is the longitudinal cross-sectional view showing a condition in which the female and male connector housings are completely fitted together.

DETAILED DESCRIPTION OF THE PREFERRED EMBODIMENTS

Figure 1:
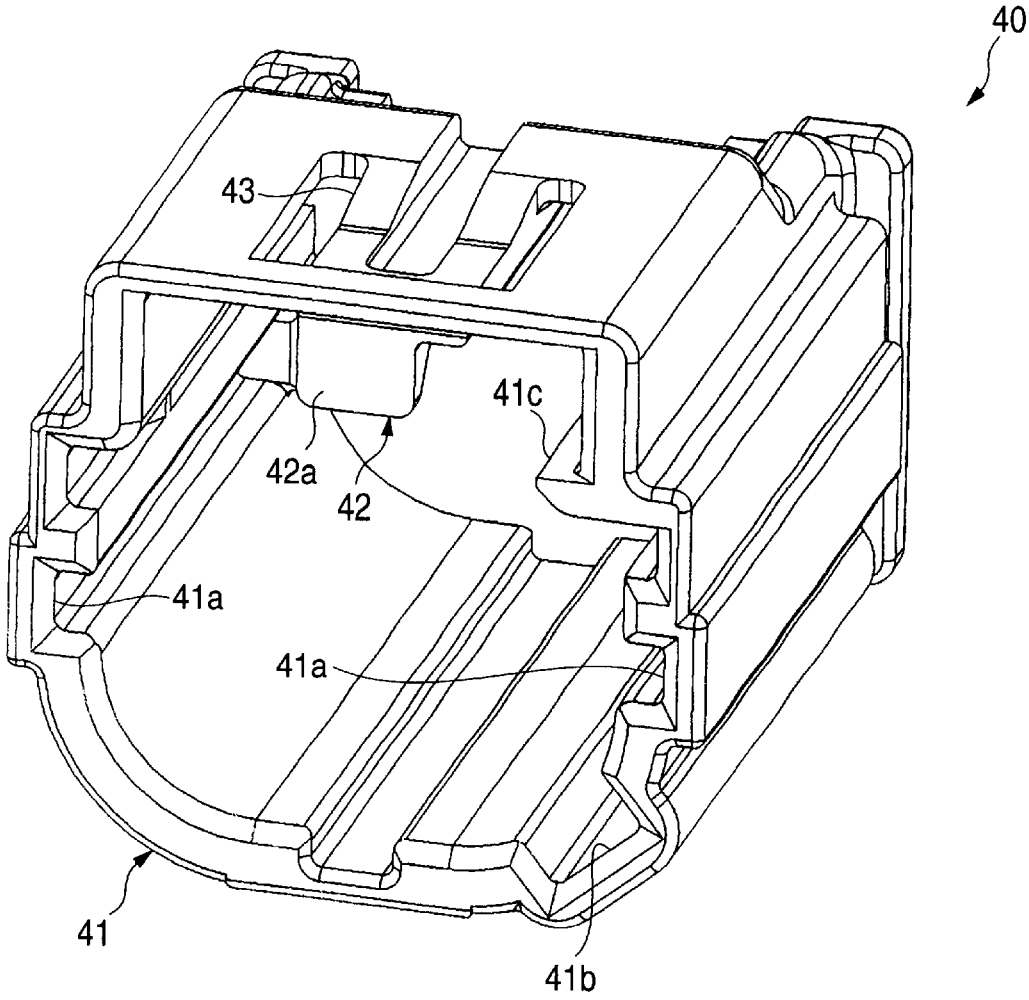
FIG. 1 is a perspective view of a fitting detection member in the first embodiment of a half-fitting prevention connector of the present invention.
Figure 2:
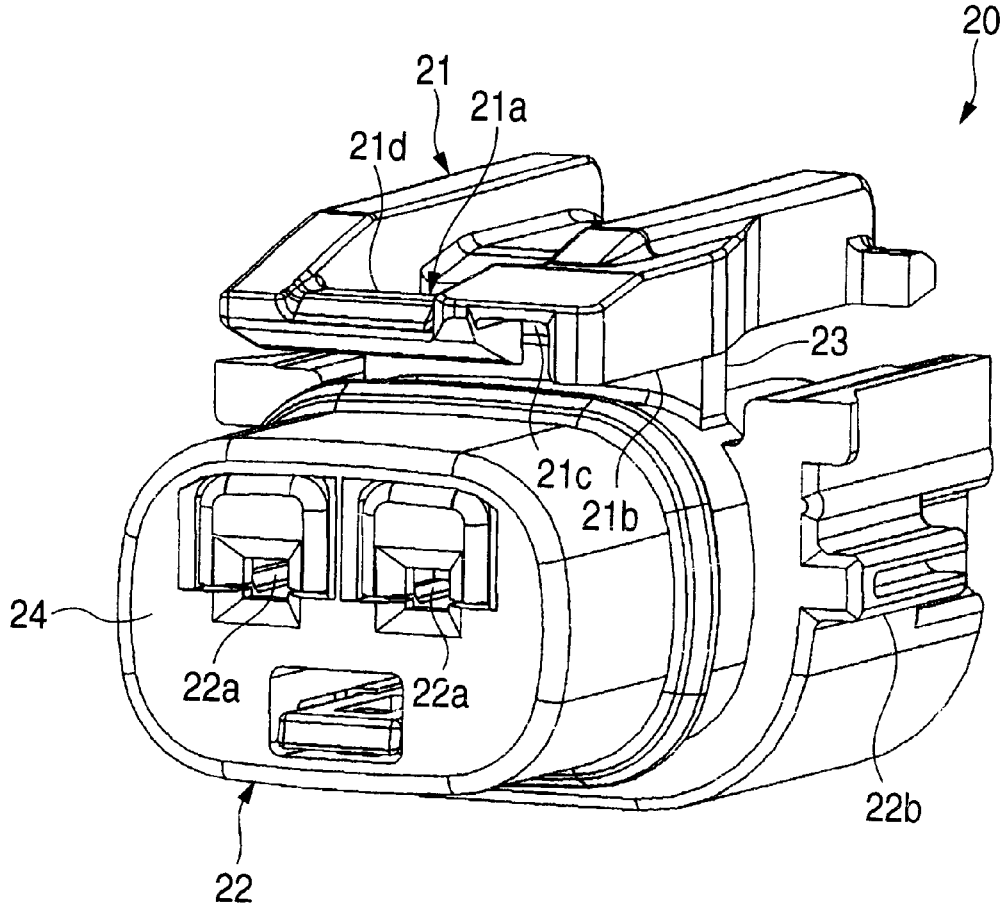
FIG. 2 is a perspective view of a female connector housing of the half-fitting prevention connector of the invention.
Figure 3:
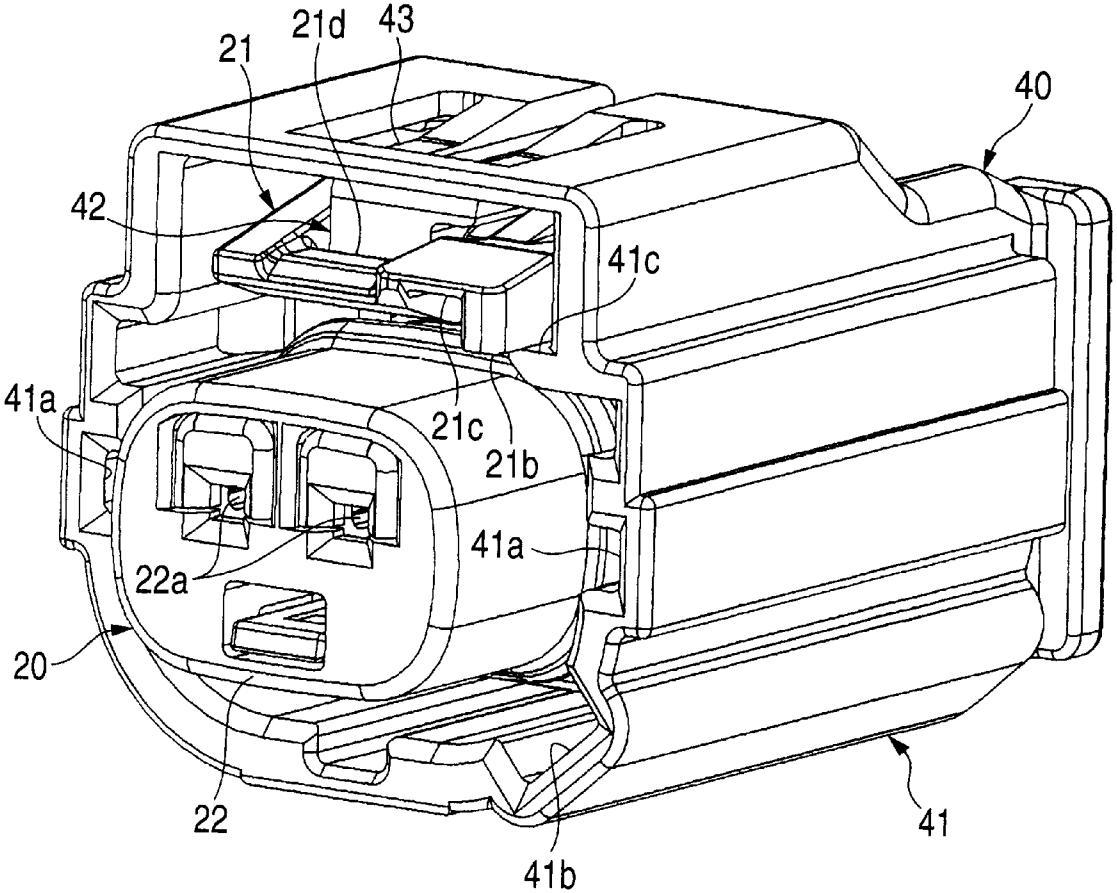
FIG. 3 is a perspective view showing a condition in which the fitting detection member is mounted on the female connector housing of the half-fitting prevention connector of the invention.
Figure 4:
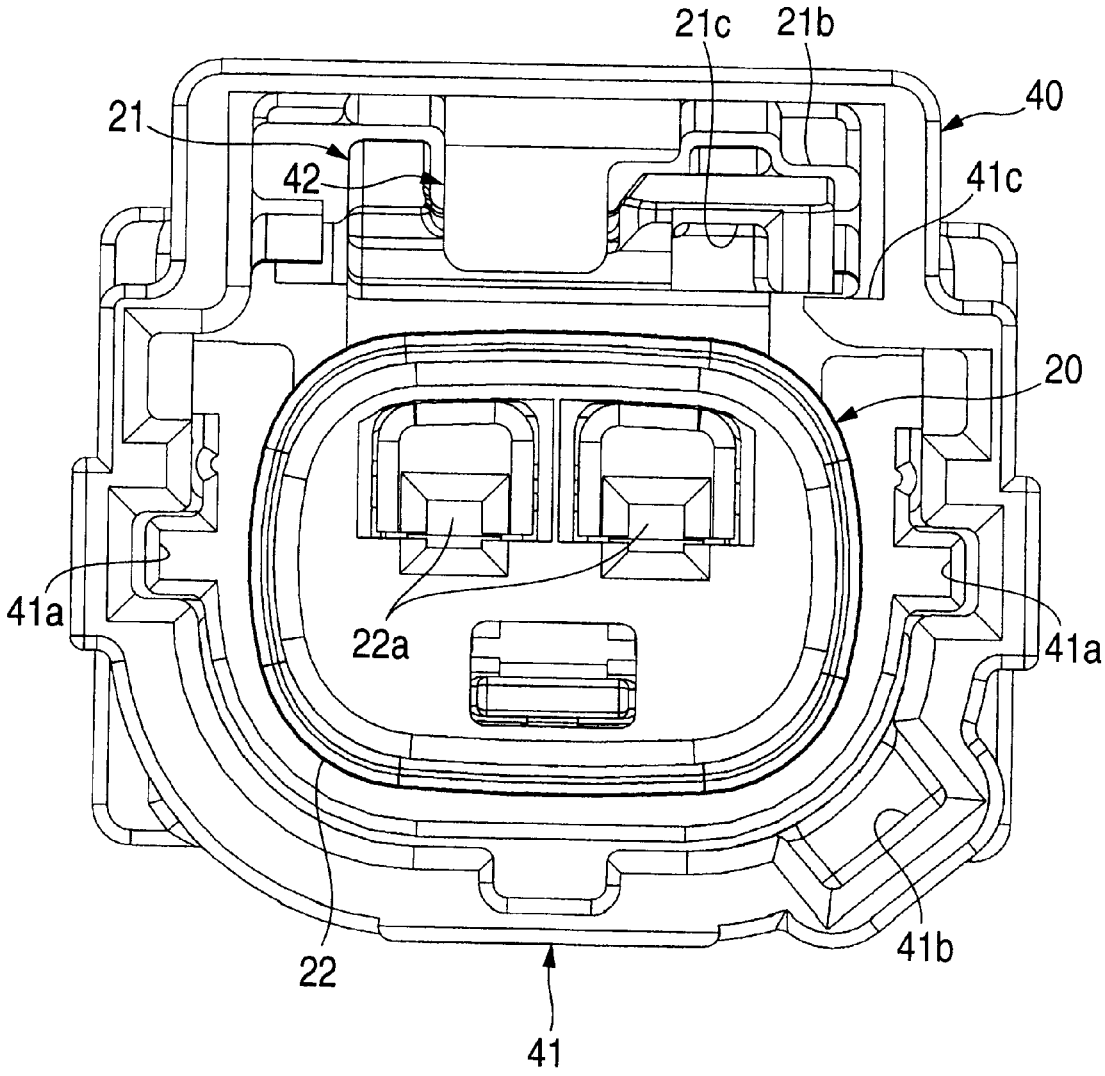
FIG. 4 is a front-elevational view showing the condition of FIG. 3.

The first embodiment of a half-fitting prevention connector of the present invention will now be described in detail with reference to FIGS. 1 to 14. FIG. 1 is a perspective view of a fitting detection member in the first embodiment of the half-fitting prevention connector of the invention, FIG. 2 is a perspective view of a female connector housing of the half-fitting prevention connector in the first embodiment of the invention, FIG. 3 is a perspective view showing a condition in which the fitting detection member is mounted on the female connector housing of the half-fitting prevention connector in the first embodiment of the invention, FIG. 4 is a front-elevational view showing the condition of FIG. 3, FIG. 5 is a longitudinal cross-sectional view showing the condition of FIG. 3, FIG. 6 is a longitudinal cross-sectional view showing a condition in which the female and male connector housings of the half-fitting prevention connector in the first embodiment of the invention are in the process of being fitted together, FIG. 7 is a longitudinal cross-sectional view showing a condition in which the female and male connector housings of FIG. 6 are completely fitted together, and FIG. 8 is a perspective view showing the condition in which the female and male connector housings are completely fitted together.

Figure 9:
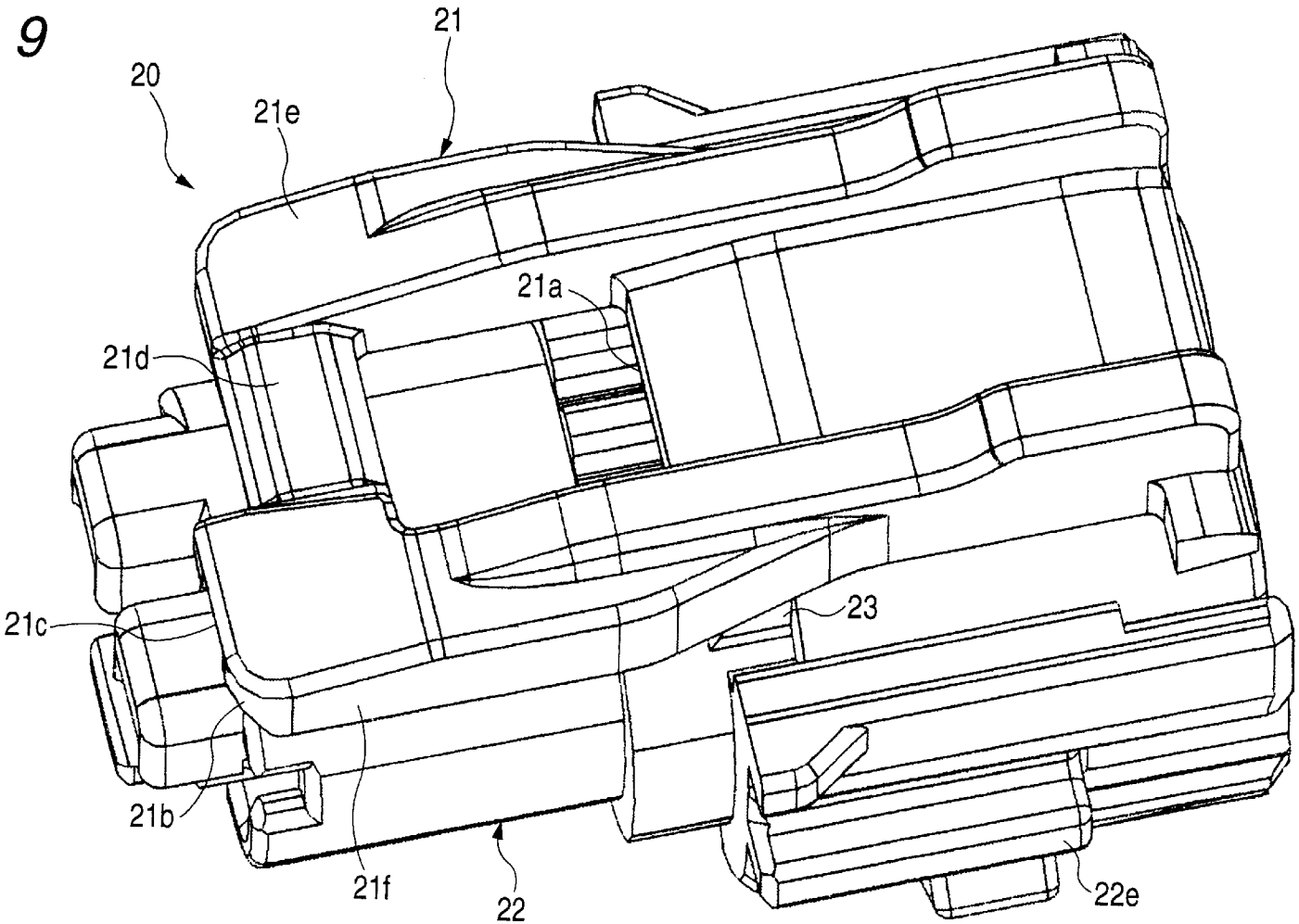
FIG. 9 is a perspective view of a female connector housing of the half-fitting prevention connector in the second embodiment of the invention as viewed from the above thereof.
Figure 10:
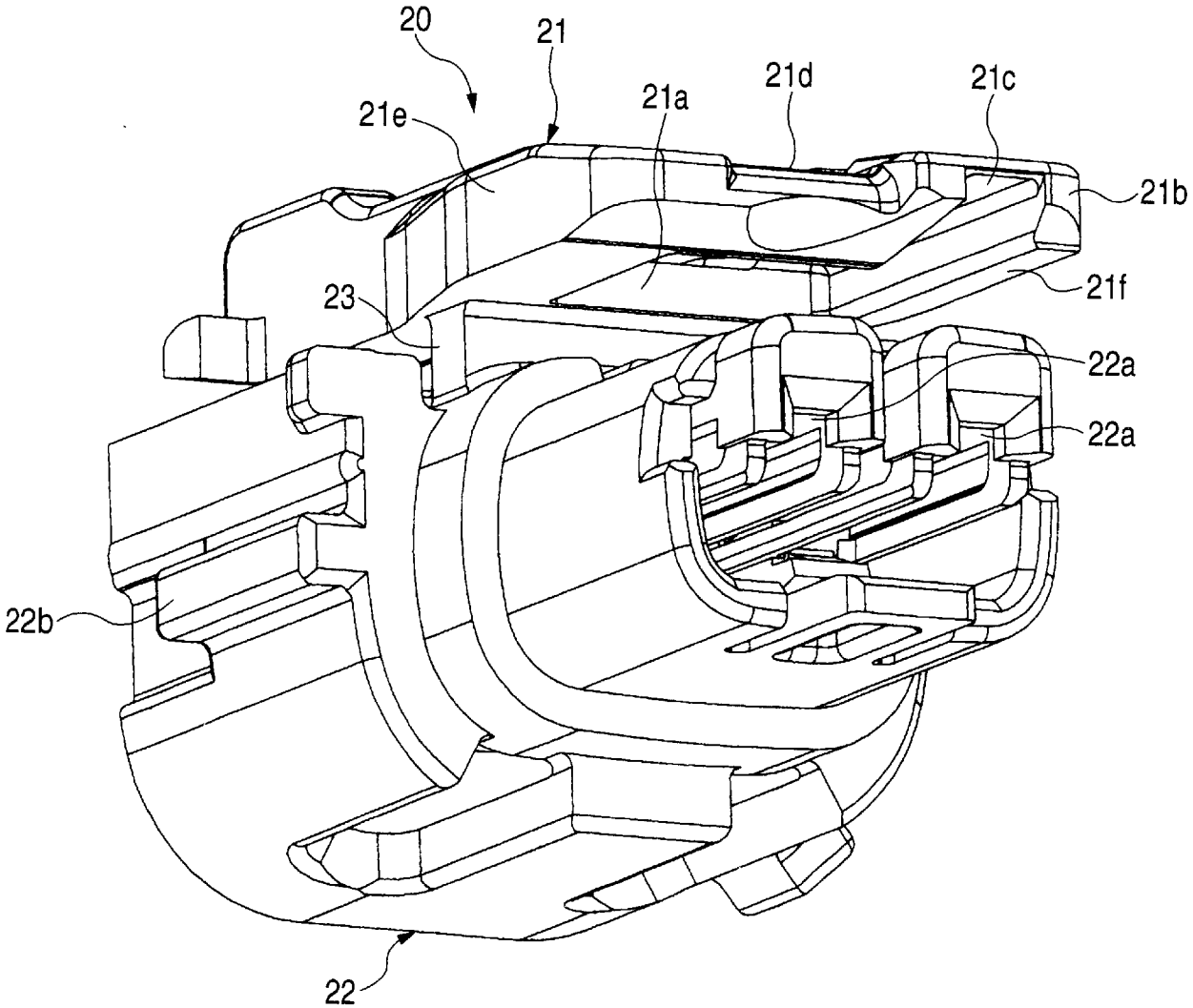
FIG. 10 is a perspective view of the female connector housing of FIG. 9 as viewed from the front side thereof.
Figure 11:
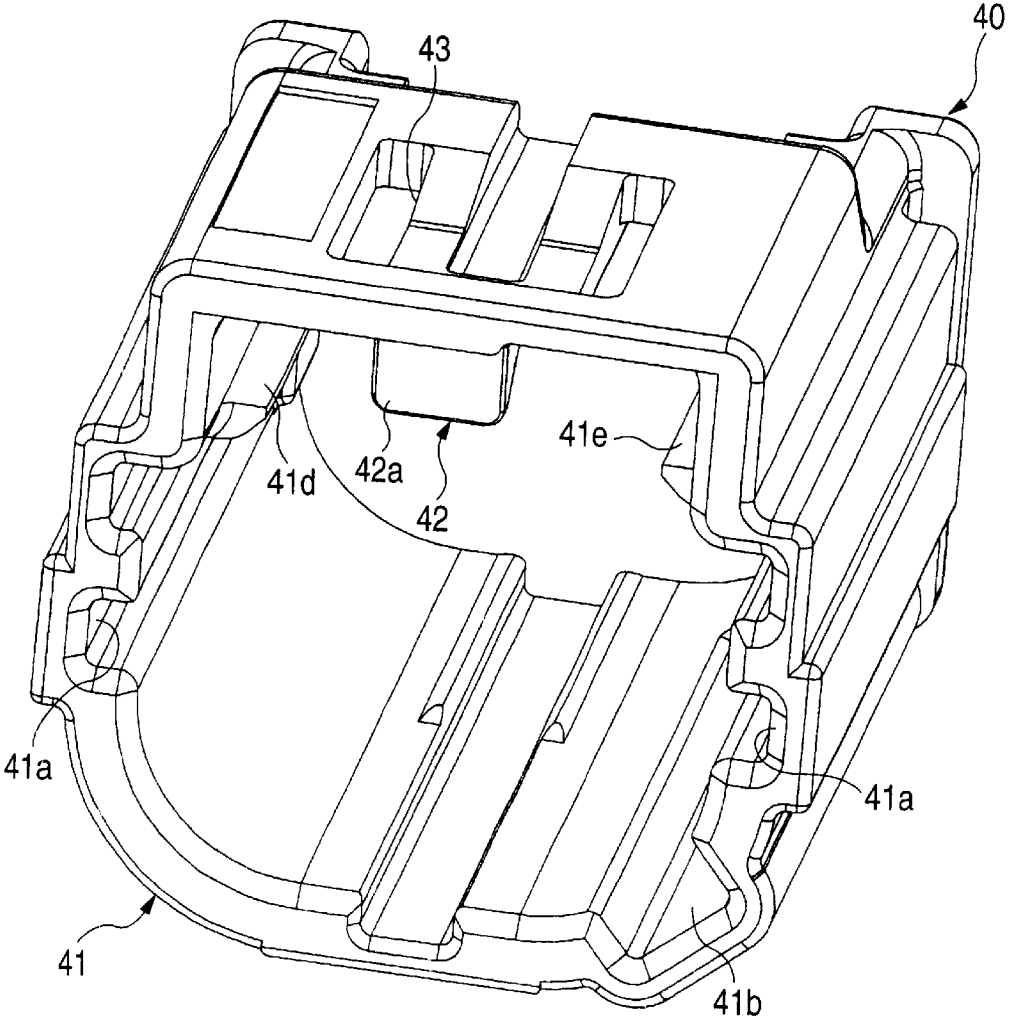
FIG. 11 is a perspective view of a fitting detection member in the second embodiment of the half-fitting prevention connector of the invention.
Figure 12:
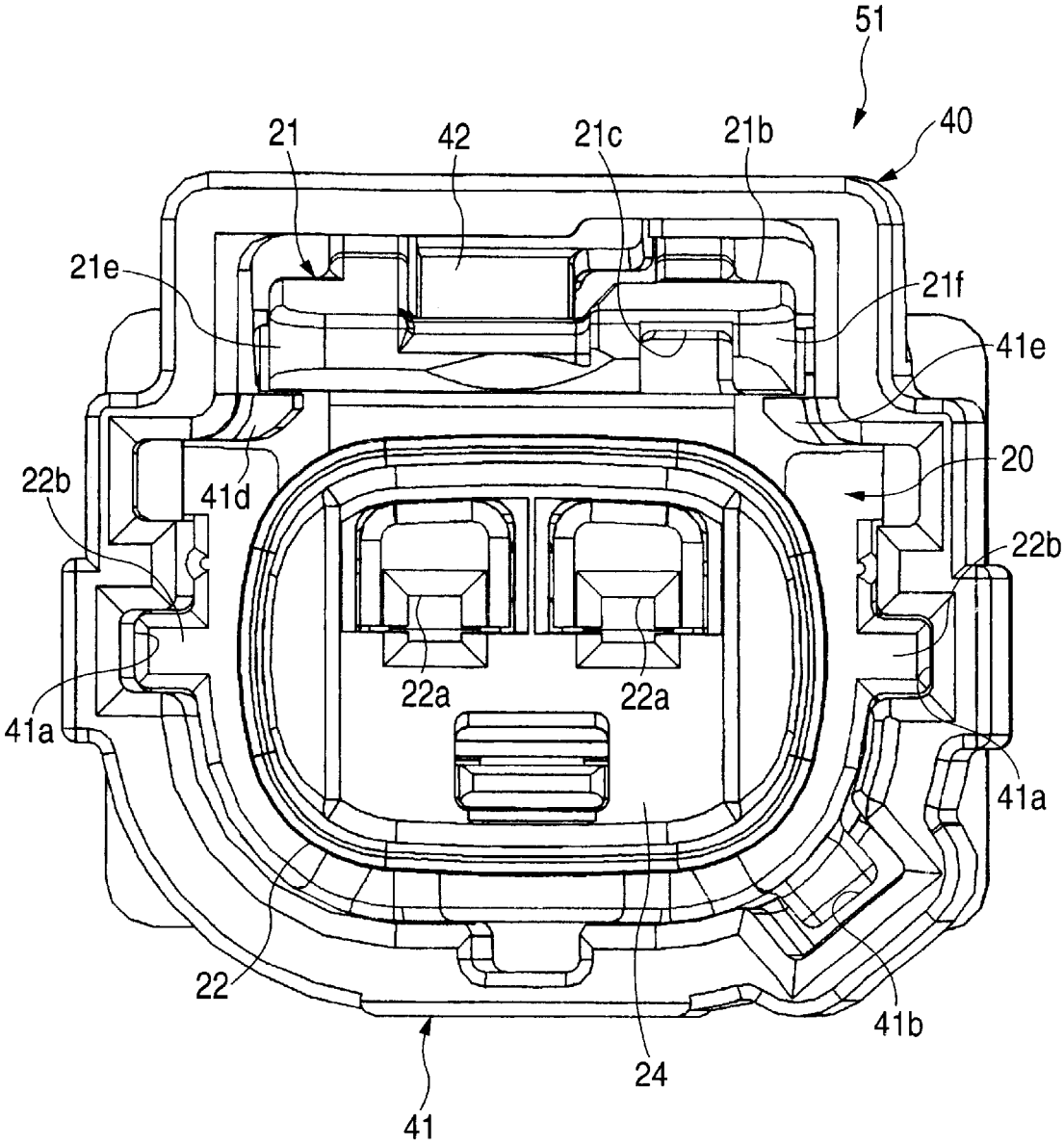
FIG. 12 is a front-elevational view showing a condition in which the fitting detection member is mounted on the female connector housing of the half-fitting prevention connector in the second embodiment of the invention.
Figure 13:
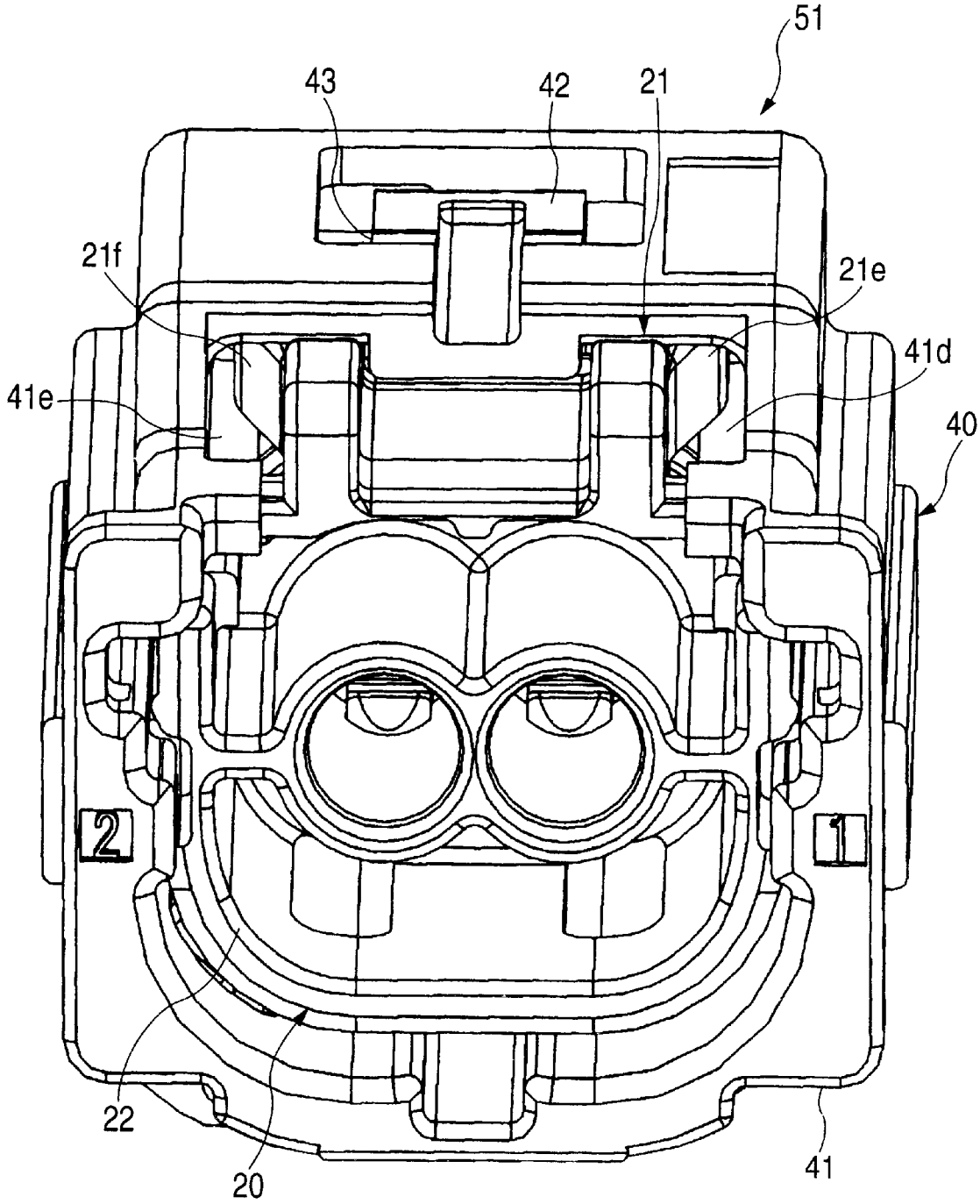
FIG. 13 is an external view showing the condition of FIG. 12 from backside thereof.
Figure 14:
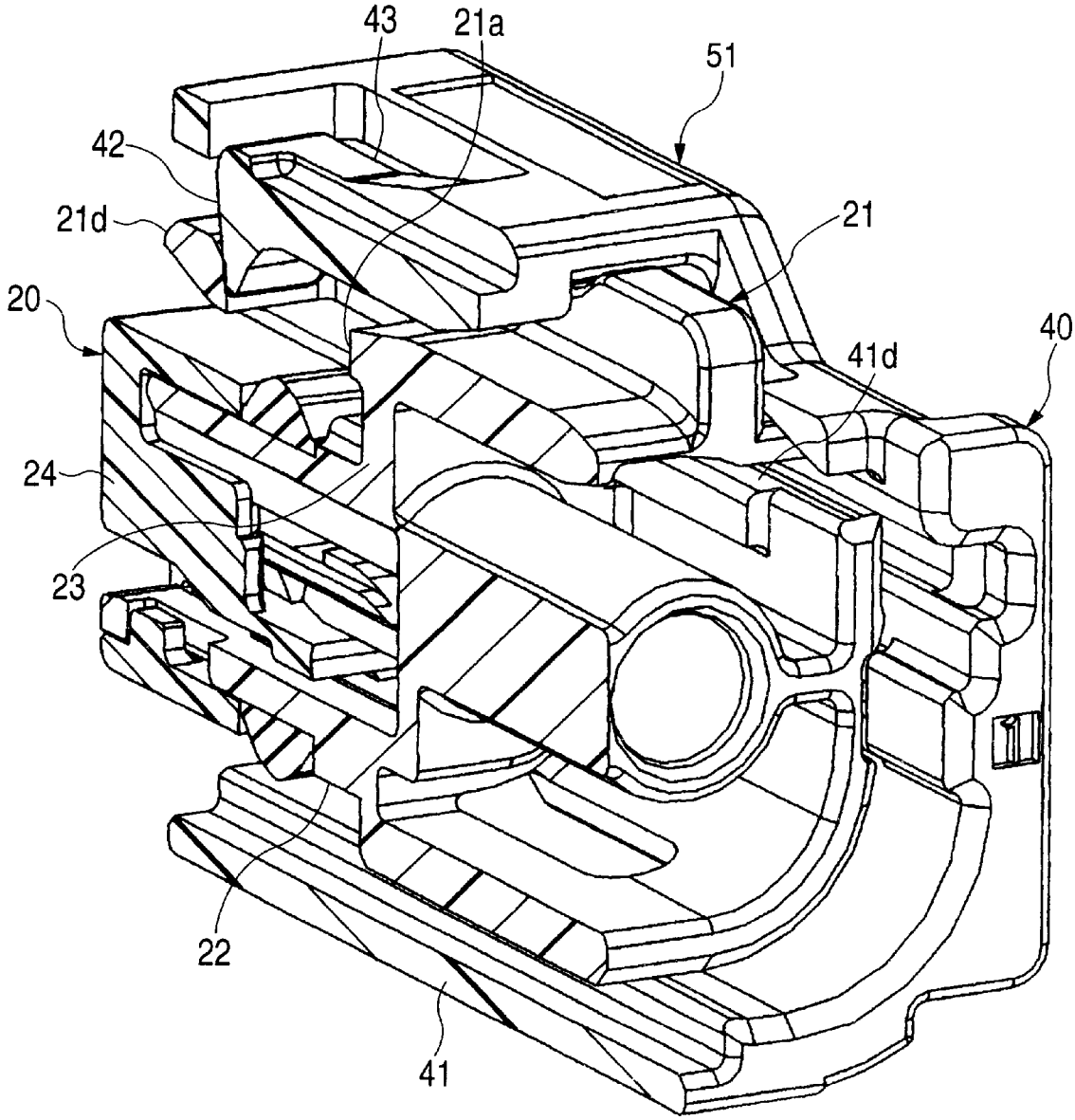
FIG. 14 is a longitudinal cross-sectional view showing the condition of FIG. 13.
Figure 15A:
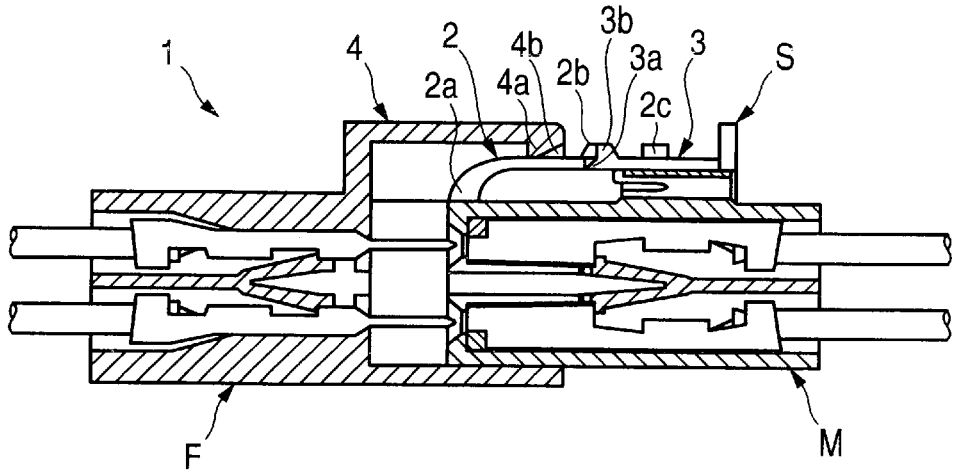
FIGS. 15A to 15C are longitudinal cross-sectional views of a conventional half-fitting prevention connector.
Figure 15B:
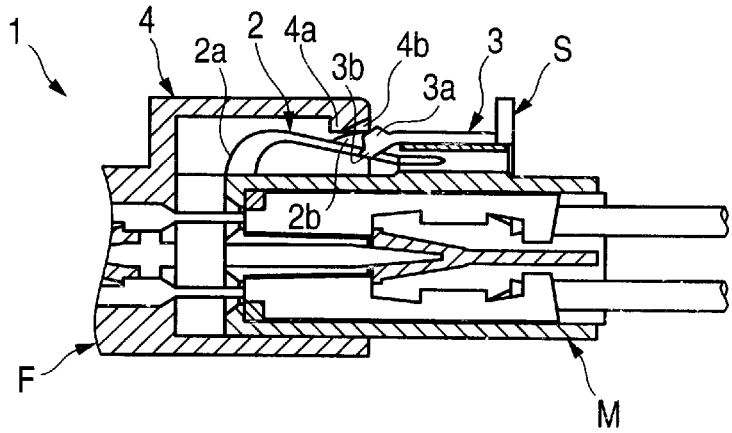
Figure 15C:
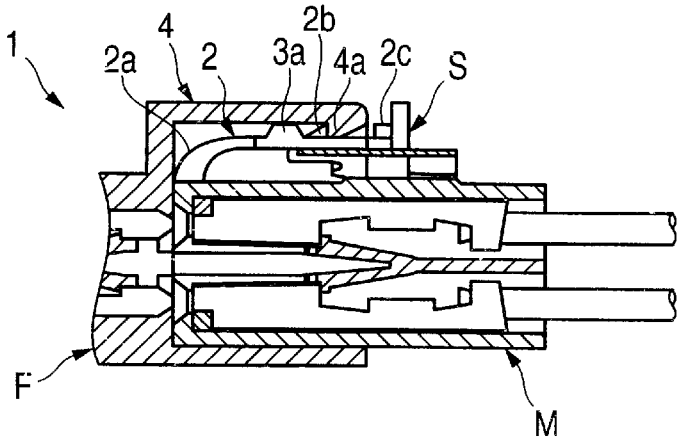

FIG. 9 is a perspective view of a female connector housing of the half-fitting prevention connector in the second embodiment of the invention as viewed from the above thereof, FIG. 10 is a perspective view of the female connector housing of FIG. 9 as viewed from the front side thereof, FIG. 11 is a perspective view of a fitting detection member in the second embodiment of the half-fitting prevention connector of the invention, FIG. 12 is a front view showing a condition in which the fitting detection member is mounted on the female connector housing of the half-fitting prevention connector in the second embodiment of the invention, FIG. 13 is an external view showing the condition of FIG. 12 from backside thereof, FIG. 14 is a longitudinal cross-sectional view showing the condition of FIG. 13.

Figure 7:
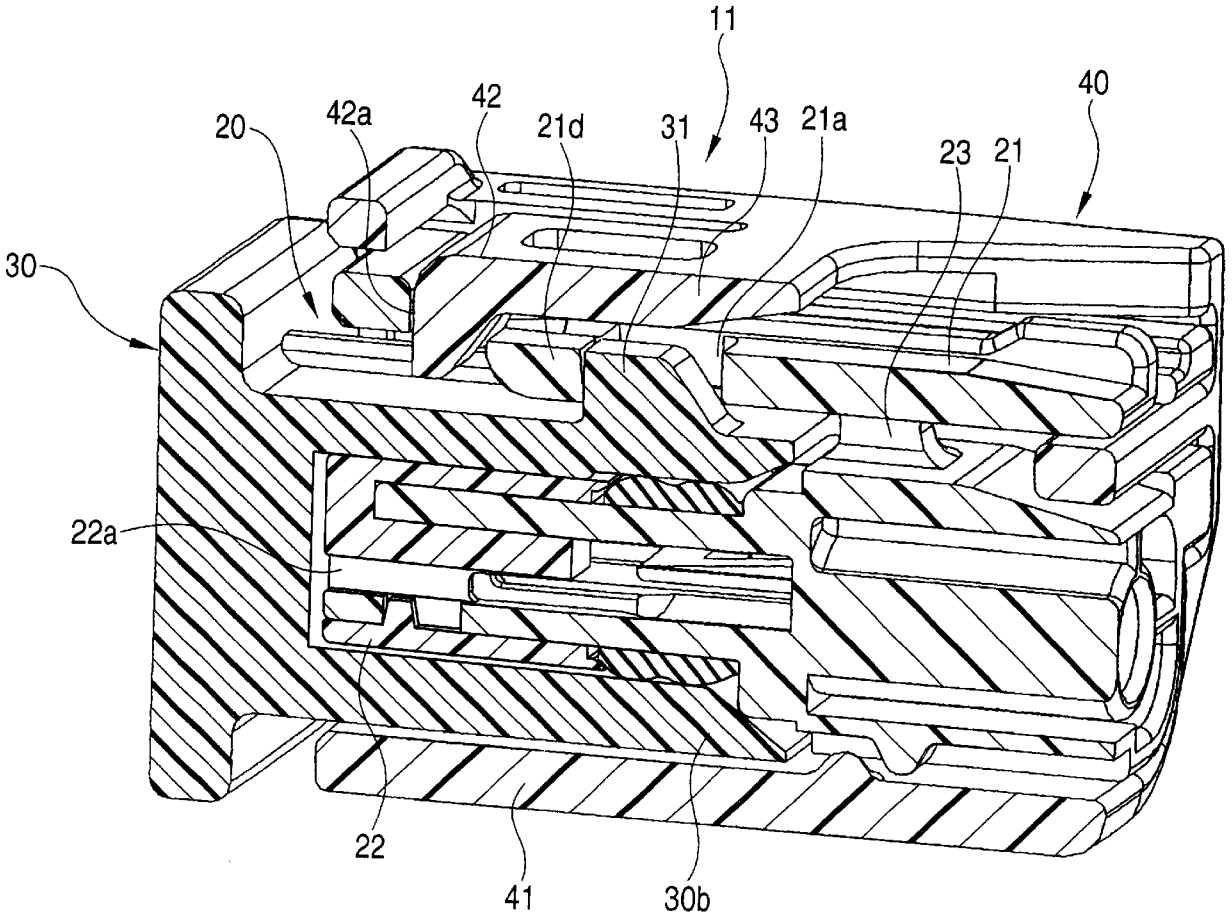
FIG. 7 is a longitudinal cross-sectional view showing a condition in which the female and male connector housings of FIG. 6 are completely fitted together.
Figure 8:
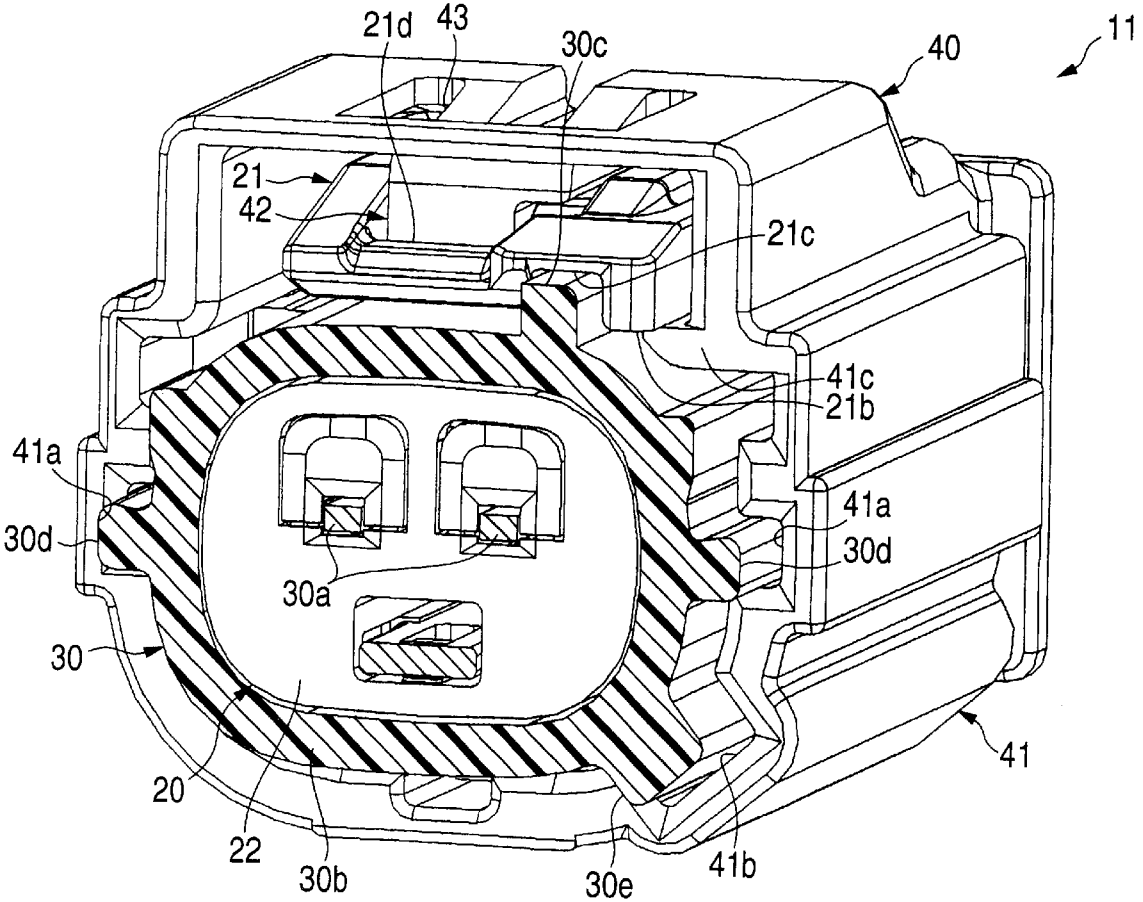
FIG. 8 is a perspective view showing the condition in which the female and male connector housings are completely fitted together.

As shown in FIGS. 7 and 8, the half-fitting prevention connector 11 of the first embodiment comprises the female connector housing (first connector housing) 20, having a flexible lock arm 21, the male connector housing (the second connector housing) 30 having an engagement projection (engagement portion) 31 for engagement in a retaining hole (lock portion) 21*a* formed in the flexible lock arm 21, and the fitting detection member 40 of a substantially tubular shape fitted on the female connector housing 20 so as to slide in a fitting direction of the connector housings.

Figure 5:
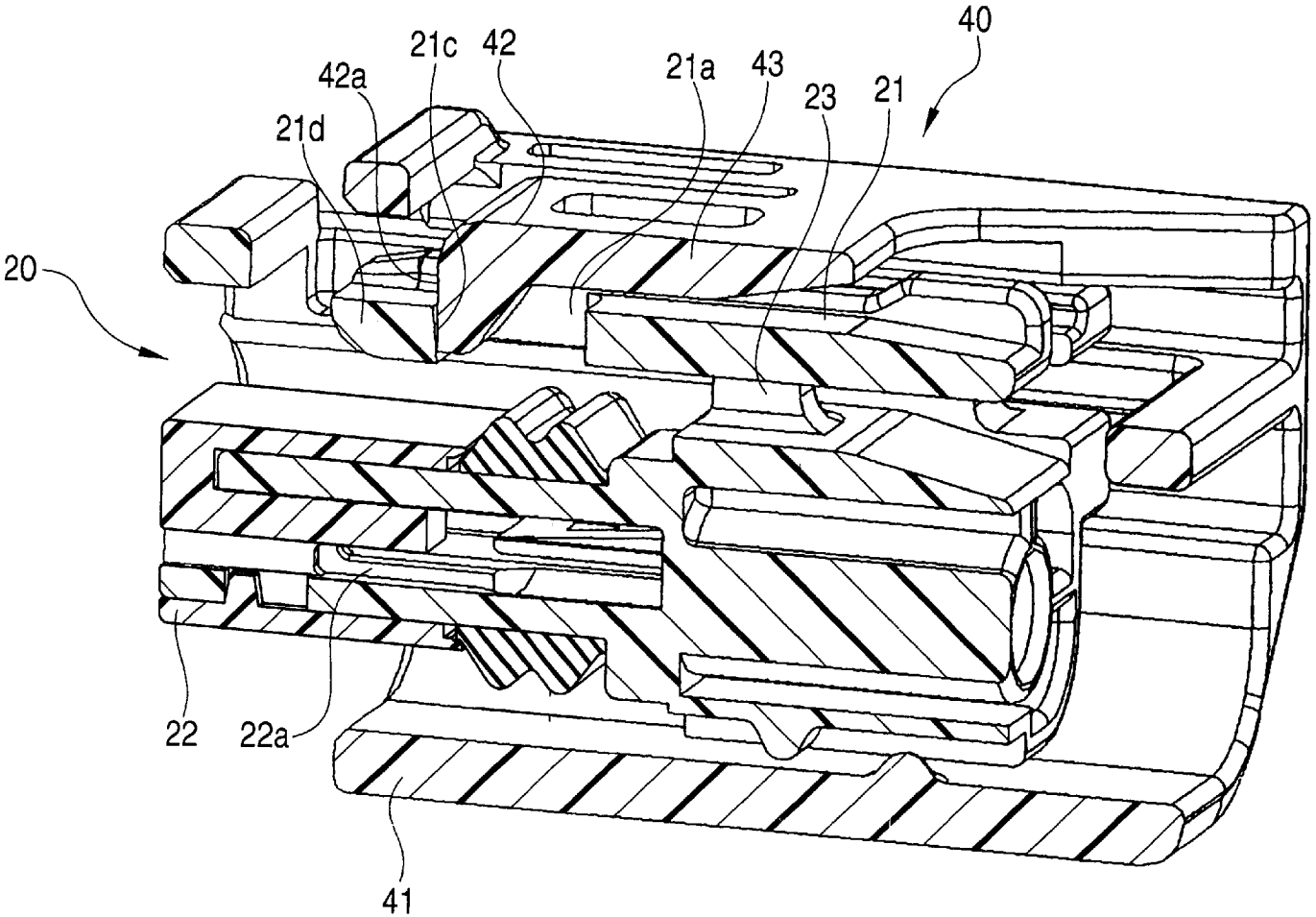
FIG. 5 is a longitudinal cross-sectional view showing the condition of FIG. 3.
Figure 6:
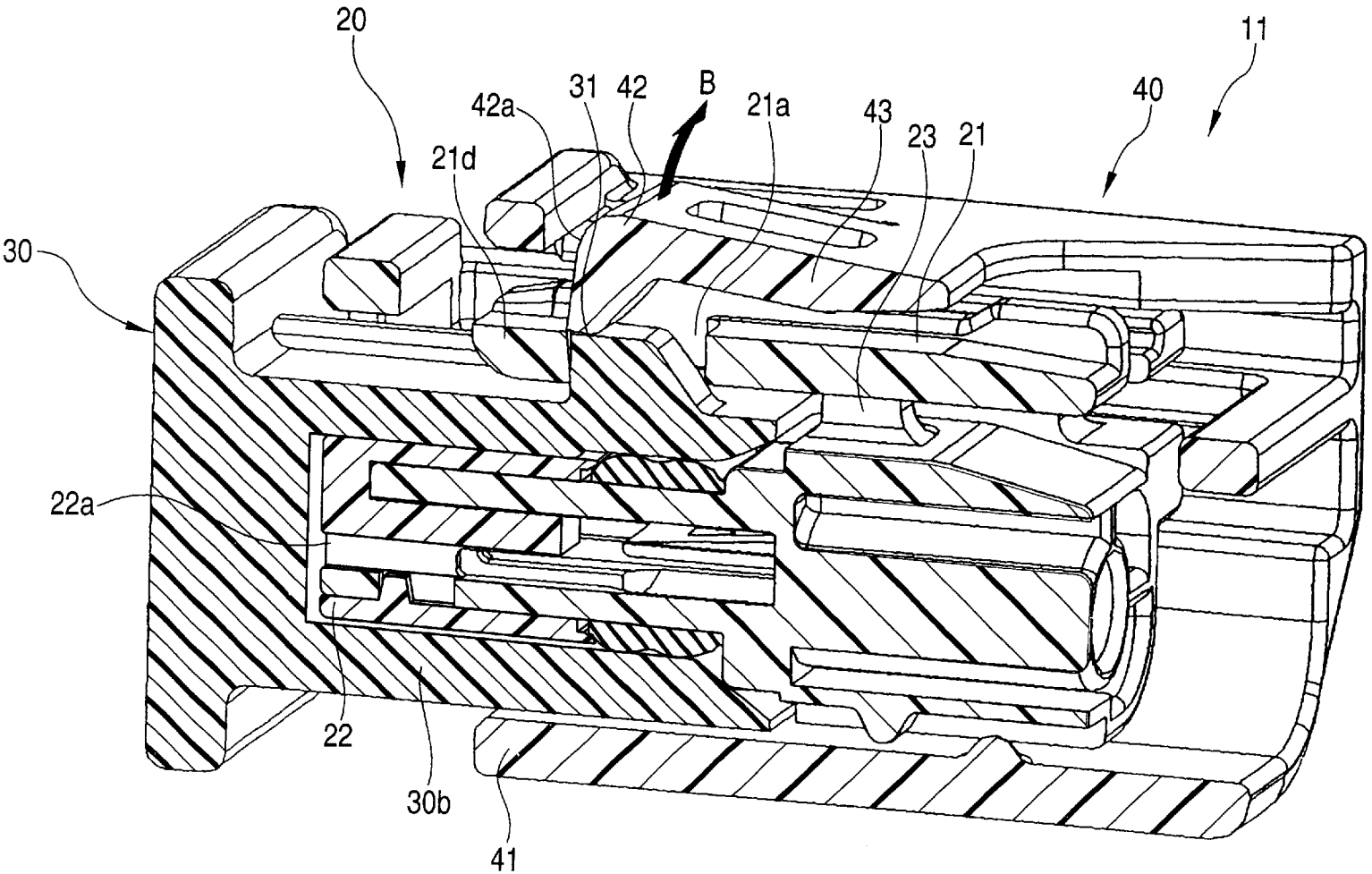
FIG. 6 is a longitudinal cross-sectional view showing a condition in which the female and male connector housings of the half-fitting prevention connector of the invention are in the process of being fitted together.

Before the female and male connector housings 20 and 30 are fitted together, the fitting detection member 40 is engaged in the retaining hole 21*a*, and therefore is held in its initial position (see FIG. 5).

When the female and male connector housings 20 and 30 are completely fitted together, the retaining of the fitting detection member by the retaining hole 21*a* is canceled by engagement of the engagement projection 31 in the retaining hole 21*a*, and the fitting detection member is slid from the initial position to a proper fitting detection position spaced a predetermined distance from the initial position. Therefore, a half-fitted condition of the female and male connector housings 20 and 30 can be detected by determining whether or not the fitting detection member 40 can be slid into the proper fitting detection position.

As shown in FIG. 2, the female connector housing 20 includes a housing body 22, having terminal receiving chambers 22*a* for respectively receiving and holding female connection terminals (not shown), and the flexible lock arm 21 formed integrally on an upper surface of the housing body 22, and a front holder 24 is mounted on the housing body 22 from the front side thereof.

The flexible lock arm 21 is formed on upper ends of support post portions 23 formed upright on a substantially central portion of the upper surface of the housing body 22, and extends forwardly and rearwardly from the support post portions 23 in a fitting direction of the housing body 22, and can be displaced in a seesaw-like manner on the support post portions 23 serving as a fulcrum.

A projecting portion 21*b* is formed at a right side portion (in the drawings) of a front portion of the flexible lock arm 21, and a lock arm guide groove 21*c* of a substantially inverted U-shape is formed in a lower surface of the projecting portion 21*b*, and extends in a forward-rearward direction of the flexible lock arm 21.

The retaining hole 21*a* is formed through that portion of the flexible lock arm 21 disposed near to the front end thereof, and a detection member-retaining portion 21*d* is formed at a front end of the retaining hole 21*a*, and this detection member-retaining portion 21*d* regulates the sliding movement of the fitting detection member 40 when this fitting detection member 40 is slid from the initial position forwardly to the proper fitting detection position. Guide portions 22*b*, each in the form of an elongate projection, are formed respectively on opposite outer side surfaces of a rear end portion of the housing body 22, and extend in the forward-rearward direction of the housing body 22.

In the half-fitting prevention connector 11 of this embodiment, the male connector housing 30 includes a housing body 30*b* in which male connection terminals 30*a* are received, and the engagement projection 31 for engagement in the retaining hole 21*a* is formed on a widthwise-central portion of an upper surface of the housing body 30*b* as shown in FIGS. 7 and 8.

A flexible lock arm-guide portion 30*c* (in the form of an elongate projection) for fitting in the lock arm guide groove 21*c* is formed on one side portion (right side portion in FIG. 8) of the upper surface of the housing body 30*b*.

Fitting detection member-guide portions 30*d* (each in the form of an elongate projection) for fitting respectively in detection member guide grooves 41*a* are formed respectively on opposite outer side surfaces of the housing body 30*b*, and also a fitting detection member-guide portion 30*e* (in the form of an elongate projection) for fitting in a detection member guide groove 41*b* is formed on one side (right side in FIG. 8) of a lower surface of the housing body 30*b*.

The engagement projection 31 is formed on and projects from the widthwise-central portion of the upper surface of the housing body 30*b*, and is disposed near to the front end thereof. When the female and male connector housings 20 and 30 are fitted together, the engagement projection 31, while kept in sliding contact with the lower surface of the flexible lock arm 21, intrudes into a gap between the housing body 22 and the flexible lock arm 21. Then, this engagement projection is fitted into the retaining hole 21*a* from the lower side of the flexible lock arm 21.

The flexible lock arm-guide portion 30*c* is fitted in the lock arm guide groove 21*c*, and the fitting detection member-guide portions 30*d* and 30*e* are fitted in the detection member guide grooves 41*a* and 41*b*, respectively, thereby properly determining the fitting direction of the female and male connector housings 20 and 30 relative to each other as well as the fitting position, so that the axes of the two connector housings are aligned with each other, and therefore the fitting operation can be effected smoothly.

As shown in FIG. 1, the fitting detection member 40 includes a detection member body 41 of a substantially tubular shape which is fitted on the outer periphery of the female connector housing 20 so as to slide in the fitting direction of the female and male connector housings 20 and 30 relative to each other, and covers the outer periphery of the housing body 22. This fitting detection member has a retaining projection (positioning retaining portion) 42 for engagement in the retaining hole 21*a* to hold the detection member body 41 in the initial position.

The detection member guide grooves 41*a*, in which the guide portions 22*b* of the female connector housing 20 can be slidably fitted, respectively, are formed respectively in the opposed inner side surfaces of the detection member body 41. The guide portions 22 are fitted respectively in the detection member guide grooves 41*a*, and therefore the detection member body is mounted on the female connector housing 20 so as to slide in the fitting direction of the female and male connector housings 20 and 30 relative to each other.

The detection member guide groove 41*b* is formed in one side (right side in FIG. 1) of an inner lower surface of the detection member body 41. When the female and male connector housings 20 and 30 are fitted together, the fitting detection member-guide portion 30*e* of the male connector housing 30 is fitted in this guide groove 41*b*, thereby aligning the axes of the male connector housing 30 and the fitting detection member 40 with each other, so that the fitting operation can be effected smoothly.

In the half-fitting prevention connector 11 of this embodiment, a flexible lock arm-holding portion 41*c* is formed on an upper portion of one inner side surface (right side surface) of the detection member body 41, and projects horizontally therefrom as shown in FIG. 1. This flexible lock arm-holding portion 41*c* is in the form of an elongate projection, and extends in the fitting direction of the female and male connector housings 20 and 30 relative to each other.

Therefore, when the female connector housing 20 is fitted in the fitting detection member 40, the lower surface of the projecting portion 21*b* of the flexible lock arm 21 is held in sliding contact with the upper surface of the flexible lock arm-holding portion 41*c* as shown in FIG. 3. Thus, the flexible lock arm-holding portion 41*c* supports the lower surface of the flexible lock arm 21, and prevents the flexible lock arm 21 from being elastically deformed downwardly (in the drawings).

The retaining projection 42 is formed on and projects from a lower surface of an elastic retaining arm 43, which is part of an upper wall of the detection member body 41, at a front end thereof, and this retaining projection 42 can be displaced at least upward. The retaining projection 42 is fitted into the retaining hole 21*a* from the upper side, with its front end surface 42*a* held against a front end surface 21*c* (see FIG. 5) of the retaining hole 21*a*, thereby holding the fitting detection member 40 in its initial position.

Next, the fitting operation of the half-fitting prevention connector 11 of this embodiment will be described.

Before the female and male connector housings 20 and 30 are fitted together, the retaining projection 42 of the fitting detection member 40, fitted on the female connector housing 20, is fitted and engaged in the retaining hole 21*a* in the female connector housing 20 from the upper side, as shown in FIGS. 4 and 5. At this time, this fitting detection member is held in the initial position where the front end surface 42*a* of the retaining projection 42 is held against the front end surface 21*c* of the retaining hole 21*a*.

The projecting portion 21*b* of the flexible lock arm 21 is supported by the flexible lock arm-holding portion 41*c*. By doing so, the downward elastic deformation of the flexible lock arm 21 is prevented, and besides the flexible lock arm 21 is corrected into the proper position before the fitting operation. Namely, the amount of engagement between the retaining hole 21*a* and the retaining projection 42 is kept to a proper value, thereby ensuring the positive engagement.

Then, the operation for fitting the female and male connector housings 20 and 30 is started, and when the male connector housing 30 is fitted into a predetermined position as shown in FIG. 6, the engagement projection 31 of the male connector housing 30 is fitted into the retaining hole 21*a* from the lower side of the flexible lock arm 21. As a result, the retaining projection 42, already engaged in the retaining hole 21*a*, is pushed out of this retaining hole by the engagement projection 31 as indicated by arrow B, thereby canceling the holding of the fitting detection member 40 in the initial position, so that the fitting detection member 40 can be moved forward.

When the female and male connector housings 20 and 30 are fitted together, the flexible lock arm-guide portion 30*c* is fitted in the lock arm guide groove 21*c* as shown in FIG. 8. The fitting detection member-guide portions 30*d* and 30*e* are fitted respectively in the detection member guide grooves 41*a* and 41*b*, thereby properly determining the fitting direction of the female and male connector housings 20 and 30 as well as the fitting position. Therefore, the axes of the female and male connector housings 20 and 30 are aligned with each other, so that the fitting operation can be carried out smoothly.

Then, when the fitting detection member 40 is moved forwardly into the proper fitting detection position as shown in FIG. 7, the retaining projection 42 is retained by the detection member-retaining portion 21*d*, thereby preventing the sliding movement of the fitting detection member 40. When the retaining projection 42 is thus brought into retaining engagement with the detection member-retaining portion 21*d*, a click feeling is produced, and therefore the completely-fitted condition of the female and male connector housings 20 and 30 can be detected.

When the fitting detection member 40 is disposed in the proper fitting detection position, the rear end of the fitting detection member 40 lies substantially flush with the rear end of the female connector housing 20, and therefore the fitted condition can be easily detected by viewing the appearance.

Next, the second embodiment of the half-fitting prevention connector of the invention will be described.

Regarding the members which have been already explained in the first embodiment, and the members having similar structure or effects to those of the first embodiment, the descriptions will be omitted, putting the corresponding number thereon.

As shown in FIGS. 12 and 13, in a connector housing 51 of the second embodiment, a pair of ribs 21*e* and 21*f* are provided on a flexible lock arm 21 of a female connector housing 21 as first connector housing. A pair of flexible lock arm-holding portion 41*d* and 41*e* are formed on a fitting detection member 40.

As shown in FIGS. 9 and 10, the female connector housing 20 is provided with the flexible lock arm 21 integrally formed on an upper face of a housing main body 22. The flexible lock arm 21 is formed on upper ends of support post portions 23 formed upright on a substantially central portion of the upper surface of the housing body 22, and extends forwardly and rearwardly from the support post portions 23 in a fitting direction of the housing body 22, and can be displaced in a seesaw-like manner on the support post portions 23 serving as a fulcrum.

A projecting portion 21*b* is formed at a right side portion in FIG. 10 of a front portion of the flexible lock arm 21, and a lock arm guide groove 21*c* of a substantially inverted U-shape is formed in a lower surface of the projecting portion 21*b*, and extends in a forward-rearward direction of the flexible lock arm 21.

The retaining hole 21*a* is formed through that portion of the flexible lock arm 21 disposed near to the front end thereof, and a detection member-retaining portion 21*d* is formed at a front end of the retaining hole 21*a*, and this detection member-retaining portion 21*d* regulates the sliding movement of the fitting detection member 40 when this fitting detection member 40 is slid from the initial position forwardly to the proper fitting detection position. A pair of ribs 21*e* and 21*f* are provided on the outer peripheral portion of the flexible lock arm 21.

The ribs 21*e* and 21*f* project from side portions of the flexible lock arm 21 so as to reinforce the stiffness of the projection 21*b* and the detection member-retaining portion 21*d*. Accordingly, the flexible lock arm 21 as a whole is enhanced in its strength and the stability is improved. Thus unnecessary deflection in a forward and downward direction is reliably prevented so that the engagement between the retaining hole 21*a* and the retaining projection 42 (described later) of the fitting detection member 40 is maintained.

As shown in FIG. 11, in the fitting detection member 40, a pair of flexible lock arm-holding portions 41*d* and 41*e* are formed on both inner side faces on the upper side (right side and left side on the upper side in the figure) of the detection member main body 41 and extend horizontally therefrom. The flexible lock arm-holding portions 41*d* and 41*e* are formed as projections extending along the fitting direction of the male and female connector housings to each other.

As shown in FIGS. 12 and 13, when the fitting detection member 40 is fitted to the female connector housing 20, lower faces of the pair of ribs 21*e* and 21*f* of the flexible lock arm 21 are brought into sliding contact with upper faces of the pair of lock arm-holding portion 41*d* and 41*e*. By this structure, the flexible lock arm-holding portion 41*d* and 41*e* support the lower face of the flexible lock arm 21, thereby reliably preventing a downward elastic deformation in the drawing of the flexible lock arm 21.

Next, the fitting operation of the half-fitting prevention connector 51 of this embodiment will be described.

Before the female and male connector housings are fitted together, the retaining projection 42 of the fitting detection member 40, fitted on the female connector housing 20, is fitted and engaged in the retaining hole 21*a* in the female connector housing 20 from the upper side, as shown in FIGS. 12, 13 and 14. At this time, this fitting detection member is held in the initial position where the front end surface 42*a* of the retaining projection 42 is held against the front end surface 21*c* of the retaining hole 21*a*.

The flexible lock arm 21 is supported by the flexible lock arm-holding portions 41*d* and 41*e*. By doing so, the downward elastic deformation of the flexible lock arm 21 is prevented, and besides the flexible lock arm 21 is corrected into the proper position before the fitting operation.

According to the half-fitting prevention connector 51, the pair of ribs 21*e* and 21*f* slidingly supported by the pair of the flexible lock arm-holding portions 41*d* and 41*e* are formed on the flexible lock arm 21.

Accordingly, the flexible lock arm 21 is enhanced in its strength and the stability is improved. Thus unnecessary deflection in a forward and downward direction is reliably prevented so that the engagement between the retaining hole 21*a* and the retaining projection 42 is maintained.

The half-fitting prevention connector of the present invention is not limited to the above embodiment, and other embodiments of the invention can be provided. For example, although the flexible lock arm-holding portion is formed on one inner side surface of the fitting detection member, the flexible lock arm-holding portions can be formed respectively on the opposed inner side surfaces of the fitting detection member, in which case the flexible lock arm can be supported at its opposite side portions by these flexible lock arm-holding portions, thereby more positively ensuring the engagement of the retaining projection in the retaining hole.

As described above, in the half-fitting prevention connector of the invention, the fitting detection member has the flexible lock arm-holding portion for preventing the flexible lock arm from being moved in the direction to cancel the engagement of the lock portion with the positioning retaining portion.

Therefore, the female and male connector housings are fitted together, the flexible lock arm-holding portion prevents the flexible lock arm from being displaced in the direction to cancel the engagement of the lock portion with the positioning retaining portion. Therefore, even if other member is brought into contact with the flexible lock arm before the female and male connector housings are fitted together, the engagement of the lock portion with the positioning retaining portion will not be canceled, and the fitting detection member can be positively held in the initial position.

And besides, when the fitting detection member is mounted on the first connector housing, the flexible lock arm is corrected into the proper position by the flexible lock arm-holding portion, thereby securing the proper amount of engagement between the lock portion and the positioning retaining portion.

Therefore, even if the flexible lock arm is deformed in the direction away from the positioning retaining portion, the flexible lock arm can be corrected so that the lock portion can be engaged with the positioning retaining portion in a proper amount. Therefore, when the female and male connector housings are fitted together, a half-fitted condition can be positively prevented.

In the half-fitting prevention connector, the flexible lock arm-holding portion is formed on and projects from at least one inner side surface of the detection member body, and therefore with this simple construction, the front portion of the flexible lock arm is prevented from being inadvertently elastically deformed downwardly. Therefore, the mutually-engaged condition of the lock portion and the positioning retaining portion can be maintained before the fitting of the female and male connector housings.

Further, in the half-fitting prevention connector, the rib slidingly supported on the flexible lock arm-holding portion is provided in the flexible lock arm. Accordingly, the flexible lock arm is enhanced in its strength and the stability is improved. Thus unnecessary deflection in a forward and downward direction is reliably prevented so that the engagement between the lock portion and the positioning retaining portion is maintained.

In the half-fitting prevention connector, the flexible lock arm-guide portion and the fitting detection member-guide portion, which extend in the fitting direction, are formed on the second connector housing, and the flexible lock arm of the first connector housing has the lock arm guide groove extending in the fitting direction of the two connector housings, and the detection member body has the detection member guide groove extending in the fitting direction.

Therefore, when the two connector housings are fitted together, the flexible lock arm-guide portion is fitted in the lock arm guide groove while the fitting detection member-guide portion is fitted in the detection member guide groove. Therefore, the axes of the first connector housing and the second connector housing can be easily aligned with each other, and at the same time the axes of the second connector housing and the fitting detection member can be aligned with each other.

Therefore, the female and male connector housings can be smoothly fitted together, and the half-fitted condition can be positively prevented.

In the half-fitting prevention connector, at least one pair of fitting detection member-guide portions are formed respectively on the opposite side surfaces of the outer periphery of the housing body, and the detection member guide grooves are formed respectively in those portions of the inner surface of the detection member body corresponding respectively to the fitting detection member-guide portions.

Therefore, the axes of the second connector housing and the fitting detection member can be positively aligned with each other, so that the fitting operation can be effected more smoothly, and the half-fitted condition can be prevented more positively.

What is claimed is:

1. A half-fitting prevention connector comprising:

a first connector housing having a flexible lock arm;

a second connector housing having an engagement portion for a first engagement with a lock portion of said flexible lock arm, and connectable to said first connector housing by the first engagement of said lock portion with said engagement portion when said second connector housing is fitted relative to said first connector housing;

a fitting detection member including a detection member body of a substantially tubular shape, fitted on an outer periphery of said first connector housing so as to slide in a fitting direction of said first and second connector housings, and a positioning retaining portion for a second engagement with said lock portion to hold said detection member body in an initial position; and a flexible lock arm-holding portion provided on said fitting detection member for preventing said flexible lock arm from being moved in a direction to cancel the second engagement of said lock portion with said positioning retaining portion.

2. A half-fitting prevention connector according to claim 1, wherein said flexible lock arm-holding portion is formed on and projects from at least one inner side surface of said detection member body.

3. A half-fitting prevention connector according to claim 1, wherein a rib slidingly supported on said flexible lock arm-holding portion is formed on said flexible lock arm.

4. A half-fitting prevention connector comprising:

a first connector housing having a flexible lock arm, said flexible lock arm having a lock arm guide groove extending in a fitting direction of said first connector housing and a second connector housing;

said second connector housing having an engagement portion for a first engagement with a lock portion of said flexible lock arm, and connectable to said first connector housing by the first engagement of said lock portion with said engagement portion when said second connector housing is fitted relative to said first connector housing; and a fitting detection member including a detection member body of a substantially tubular shape, fitted on an outer periphery of said first connector housing so as to slide in the fitting direction of said first and second connector housings, said detection member body having a detection member guide groove extending in the fitting direction of said first and second connector housings, and a positioning retaining portion for a second engagement with said lock portion to hold said detection member body in an initial position;

wherein a flexible lock arm-guide portion and a fitting detection member-guide portion, which extend in the fitting direction of said first and second connector housings, are formed on said second connector housing; and when said first and second connector housings are fitted together, said flexible lock arm-guide portion is fitted in said lock arm guide groove while said fitting detection member-guide portion is fitted in said detection member guide groove.

5. A half-fitting prevention connector according to claim 4, wherein said fitting detection member-guide portions are formed at least one pair on opposite side surfaces of an outer periphery of a housing body respectively, and said detection member guide grooves are formed respectively on an inner surface of said detection member body corresponding respectively to said fitting detection member-guide portions.

* * * * *